US006129163A

United States Patent [19]

Hamilton et al.

[11] Patent Number: 6,129,163

[45] Date of Patent: Oct. 10, 2000

[54] FLIGHTLESS ROCK AUGER WITH QUICK ATTACHMENT AND METHOD OF USE

[76] Inventors: Gary Hamilton, 5890 New Haven Rd., New Haven, Ky. 40051; Charles Hamilton, 2261 New Haven Rd., Bardstown, Ky. 40004

[21] Appl. No.: 09/066,194

[22] Filed: Apr. 24, 1998

[51] Int. Cl.[7] ..... E21B 10/00; E21B 17/14

[52] U.S. Cl. ..... 175/403; 175/320; 175/402; 408/204; 408/238

[58] Field of Search ..... 175/402, 403, 175/320, 394, 426; 408/204, 207, 238; 403/378, 379.5

[56] References Cited

U.S. PATENT DOCUMENTS

| | | | |
|---|---|---|---|
| 2,006,829 | 7/1935 | Hansen | 175/403 X |
| 2,021,184 | 11/1935 | Hill | 175/403 X |
| 2,298,975 | 10/1942 | Shelburne | 408/204 |
| 2,918,260 | 12/1959 | Tilden | 175/403 X |
| 2,946,557 | 7/1960 | Pepper | 175/403 X |
| 3,162,257 | 12/1964 | Noyes | 175/403 |
| 3,220,449 | 11/1965 | Franklin | 408/204 X |
| 3,273,932 | 9/1966 | Burner | 175/320 X |
| 3,360,285 | 12/1967 | Huckshold | 403/292 |
| 3,628,675 | 12/1971 | Balogh . | |
| 3,792,741 | 2/1974 | Hopler, Jr. | 175/321 X |
| 3,848,687 | 11/1974 | Funakubo . | |
| 4,173,836 | 11/1979 | Paurat | 37/81 |
| 4,199,033 | 4/1980 | Van Gundy, Jr. . | |
| 4,458,949 | 7/1984 | Jury . | |
| 4,474,248 | 10/1984 | Musso . | |
| 4,632,195 | 12/1986 | Emmerich | 175/320 |
| 4,671,367 | 6/1987 | Brunsing . | |
| 4,968,101 | 11/1990 | Bossow . | |
| 5,082,068 | 1/1992 | Cornell . | |
| 5,377,767 | 1/1995 | Briggs . | |
| 5,474,334 | 12/1995 | Eppink | 175/74 X |

OTHER PUBLICATIONS

Exhibit "A" shows an core drill auger haivng Road, Sheperdsville, KY 40165.

*Primary Examiner*—Eileen Dunn Lillis
*Assistant Examiner*—Jong-Suk Lee
*Attorney, Agent, or Firm*—Carrithers Law Office; David W. Carrithers

[57] ABSTRACT

A flightless rock auger For drilling postholes through rock without the use of hydraulic pressure. The rock auger has a plurality of teeth extending downwardly at a selected angle from the edge of a cylinder connected to a quick connect shaft. The rock auger is utilized for drilling through rock and used in combination with a conventional flighted auger used for drilling postholes in dirt and clay. During a posthole drilling operation, the rock auger is substituted for the flighted auger as needed for drilling through and remove rock or other hard material such as concrete fron the posthole. The rock auger is designed for use at very low revolutions per minute and utilizes only the weight of the auger and shaft and does not require any additional hydraulic pressure for cutting a circular hole through the rock and forming a plug which is to be lodged in the cavity of the rock auger cylinder to be removed from the posthole. The quick connection shaft enables the conventional flighted auger to be quickly substituted for the rock auger to facilitate fast removal of soft dirt from the posthole. The rock auger provides an alternative method for utility companies to drill postholes for electric poles, telephone poles, pilings, and the like without the use of explosives, thereby providing for safer excavation.

14 Claims, 3 Drawing Sheets

FLIGHTLESS ROCK AUGER WITH QUICK ATTACHMENT AND METHOD OF USE

BACKGROUND OF THE INVENTION

The present invention relates to a flightless rock auger suspended from a derrick and powered by a shaft linked to a power source for removing plugs of rocks from post holes.

Poles for power lines and communication purposes are required to be vertical and arranged in straight lines. The poles may be planted in positions which are relatively inaccessible. A crane may be utilized for providing an outreaching means. Typically a digger derrick consists of a telescopic mobile crane from which is suspended a torque head. A flighted auger is suspended from the torque head and utilized for drilling in soil containing loose rock. The digger derrick is advantageous for extending the auger to the desired location. The auger may be stowed in a fixed position or extended in a telescoping position as needed to reach the desired location for drilling the hole.

Depending on the nature of the digging device, its digging element, or auger, torque head or hydraulic pressure is typically exerted on the digging element via air or oil hydraulic pressure exerted by the crane or cylinder in cooperative engagement therewith for forcing the digging element into the earth.

Although the conventional flighted auger is adequate for drilling through soil, or even soil with loose rock, the drilling operation must be suspended upon hitting a large rock or rock ledge because the flighted auger cannot penetrate the hard rock surface. The flighted auger is then lifted out of the hole and conventional methods of removing the obstruction with a steel shaft, crowbar, or explosive charge are used to break-up the hard rock. The flighted auger is then lowered back into the hole to remove the loose rock and soil.

A considerable amount of time is lost during the rock break-up and removal procedure. Moreover, an effort is continually being made to minimize work with explosives due to the liability of injury to workers and/or damage to residents or businesses in the area which may be in the area of the blasting zone and susceptible to rock or vibration damage.

The present invention provides a flightless rock auger having a cylindrical hollow cutting head and a plurality of teeth extending from the lower periphery thereof. A support member extends across a portion of the cylindrical hollow cutting head providing a means for cooperative engagement with a shaft extending outwardly therefrom. A quick disconnect coupling is disposed upon the distal end of the shaft.

A preferred embodiment of the flightless rock auger system for use with a drilling rig includes a flightless rock auger having a cylindrical hollow cutting head with a plurality of cutting teeth extending from the bottom edge of the cutting head. A support member extends across a portion of the cylindrical hollow cutting head providing a means for cooperative engagement with a vertical drive shaft extending outwardly therefrom. A quick disconnect coupling is disposed upon the distal end of the shaft. A means for rotating the drive shaft such as a mechanical or fluid drive may also power the hydraulic mechanism for lifting and lowering the drive shaft which utilizes its own weight for exertion of downward pressure onto the hard substrate.

A method of removing hard substrate from a posthole, using a flightless rock auger with a drilling rig simply requires the attaching a flightless rock auger having a cylindrical hollow cutting head and a plurality of cutting teeth extending from the bottom edge of the cutting head. A support member extends across a portion of the cylindrical hollow cutting head providing a means for cooperative engagement with a vertical drive shaft extending outwardly therefrom. A quick disconnect coupling is disposed upon the distal end of the shaft to means for rotating the drive shaft. The flightless rock auger is lowered into a posthole containing a hard substrate and resting the flightless rock auger onto the hard substrate. The auger is rotated at a very low rpm for from about 3 rpm to about 10 rpm forming a plug of hard substrate inside of the cylindrical body of the flightless rock auger. Lifting the flightless rock auger and the plug from the posthole is simple and the plug of the hard substrate is removed from the flightless rock auger head. The flighted auger is then substituted for removing soil from the posthole.

Accordingly, it is a principal object of the present invention to provide a flightless auger device for digging through hard rock.

It is another object of the present invention to provide an flightless auger which is capable of drilling through rock and forming a plug removable from the flightless auger.

It is another object of the present invention to provide a flightless auger utilizing an attachment means which is interchangeable with the attachment means typically used with conventional flighted augers for drilling operations.

It is therefore another object of the present invention to design a flightless auger for use at very low revolutions per minute (rpm) to maximize safely and prevent damage to the equipment.

It is an object of the present invention to provide an adapter extending from a shaft for use with a torque head of a drilling derrick.

Another object is to provide a flightless auger having teeth extending outward at a forward angle.

It is another object to provide a flightless auger having a drill head portion utilizing an end diameter of greater diameter than the plug receiving inner diameter.

It is yet another object of the present invention to utilize a plurality of diagonal ribs to minimize suction between the exterior of the drilling head and the walls of the drilled hole.

It is yet another object of the present invention to provide an access port in the top end of the drilling head for removal of the rock plug formed therein.

SUMMARY OF THE INVENTION

The present invention achieves the above objects by providing a flightless rock auger for drilling postholes through rock and hardpan.

The flightless rock auger comprises a cylindrical head defining a plurality of teeth extending downwardly from the periphery of the bottom edge at a selected forward angle. The top of the head is connected to a shaft having a quick disconnect adapter on the opposing distal end.

The rock auger is utilized in combination with a conventional flighted auger used for drilling postholes in dirt and clay. During a posthole drilling operation, the rock auger is substituted for the flighted auger when needed to drill through and remove rock or other hard material such as concrete from the posthole. The rock auger is designed for use at very low revolutions per minute and utilizes only the weight of the auger and shaft and does not require any additional hydraulic pressure for cutting a circular hole through the rock and forming a plug which is be lodged in the cavity of the rock auger cylinder to be removed from the posthole. The quick connection shaft enables the conventional flighted auger to be quickly substituted for the flightless rock auger to facilitate fast removal of soft dirt from the posthole. The rock auger provides a means for utility companies to utilize a means for drilling postholes for electric poles, telephone poles, pilings, and the like without the use of explosives; thereby providing a safer means of excavation.

When the drilling operation encounters rock, rather than blasting through the rock with explosives, or calling a truck utilize a pressurized auger with flights, the non-pressurized flightless rock auger can be fitted onto the torque head of a conventional drilling shaft and used to drill through the rock. A plug may be formed in the head by the drilling operation; however, the plug is removed by using had tools which fit into openings formed in the top end of the drilling head.

BRIEF DESCRIPTION OF THE DRAWINGS

A better understanding of the present invention will be had upon reference to the following description in conjunction with the accompanying drawings in which like numerals refer to like parts throughout the several views and wherein.

DETAILED DESCRIPTION OF THE PREFERRED EMBODIMENT

Figure 3:
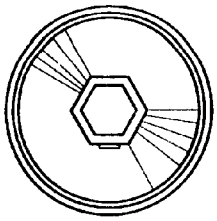
FIG. 3 is a top view of the invention of FIG. 1.

The nonpressurized flightless rock auger 10 with quick attachment coupling 11 of the present invention is manufactured from readily available materials and simple in design. The preferred embodiment is comprised of metal, more particularly steel. The rock auger 10 is mounted on construction equipment such as hydraulic drilling rigs. A drive shaft 12 in communication with a drilling rig motor 14 or circulation of a hydraulic fluid from a pump on the drilling rig 16 may be used to drive the hydraulic motor 18 of the construction equipment.

Referring now to the drawings, FIGS. 1–8 refer to the present invention including a standard drive shaft 12 utilizing a quick disconnect coupling 11 extending from the distal end 13 of the shaft 12. The shaft 12 is centrally aligned with the axis of the hollow cylindrical body 20 and secured to the proximal end, or top end 22, of the cutting head 24 opposite the open end 26 having the cutting edge. The top end 22 is at least partially enclosed to provide structural strength. One or more reinforcements member such as the triangular members 28 may be welded to the shaft 12 and the top end 22 of the cutting head 24 to provide additional lateral and rotational strength.

Figure 4:
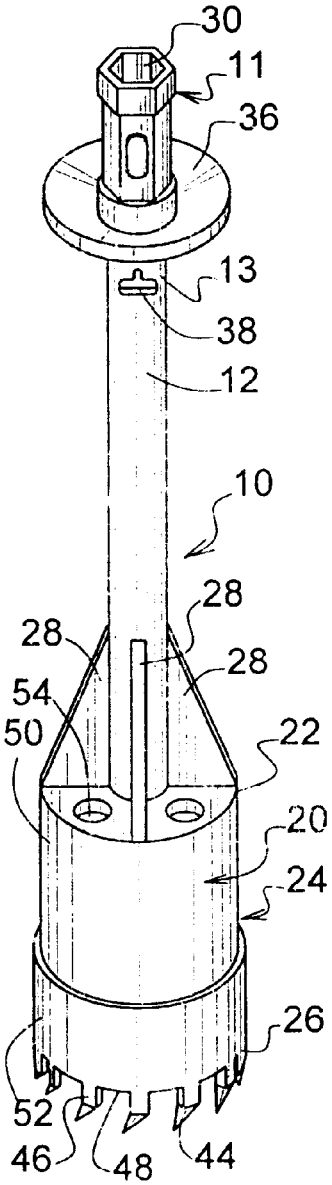
FIG. 4 is a perspective view of the invention of FIG. 1.
Figure 1:
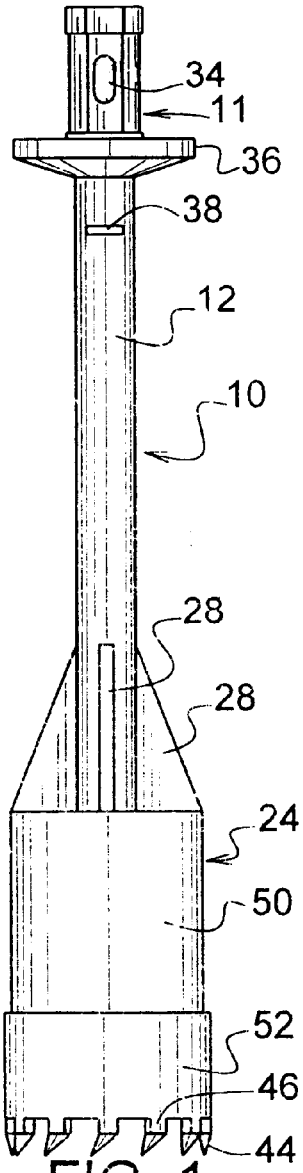
FIG. 1 is a front perspective view of the present invention showing the shaft with a quick disconnect distal end, a cylindrical body and drill head having a greater diameter than the body wherein a plurality of teeth extend downward at an angle from the outer edge of the drill head.
Figure 2:
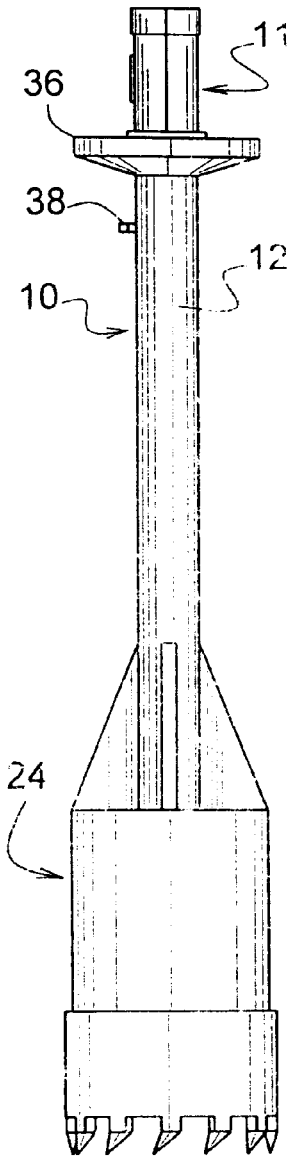
FIG. 2 is a side perspective view of the invention of FIG. 1.
Figure 5:
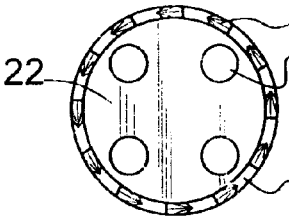
FIG. 5 is a bottom view of the invention of FIG. 1.
Figure 6:
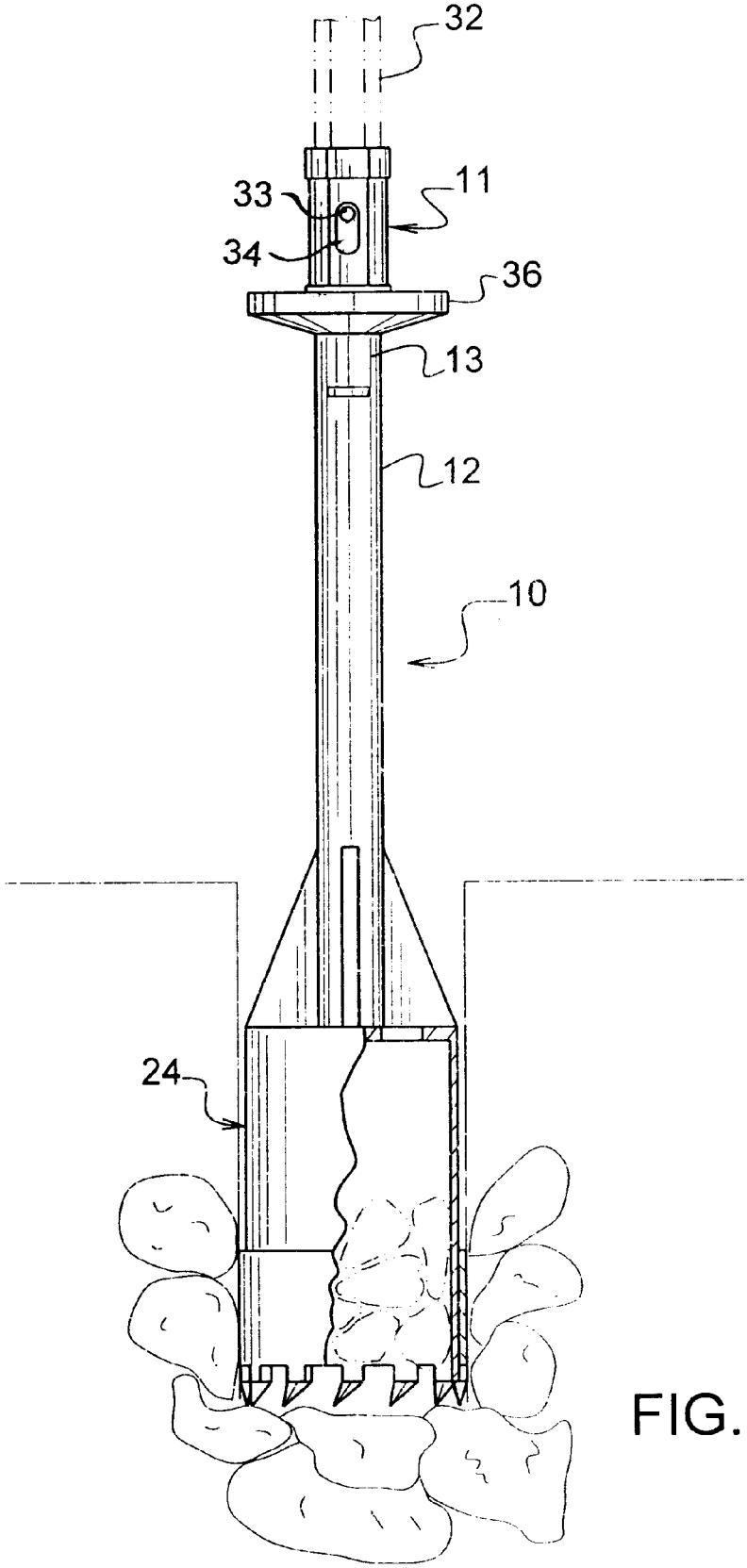
FIG. 6 is a partial cutaway view of the invention of FIG. 1 shown drilling through rock forming a plug therein.
Figure 7:
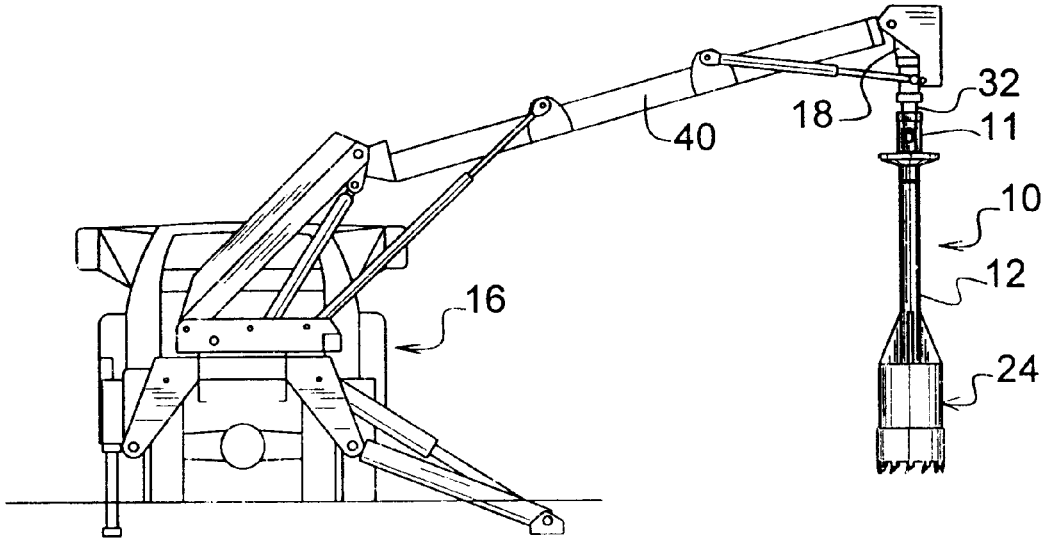
FIG. 7 is a perspective view of an embodiment of a mobile drilling rig utilizing the present invention.
Figure 8:
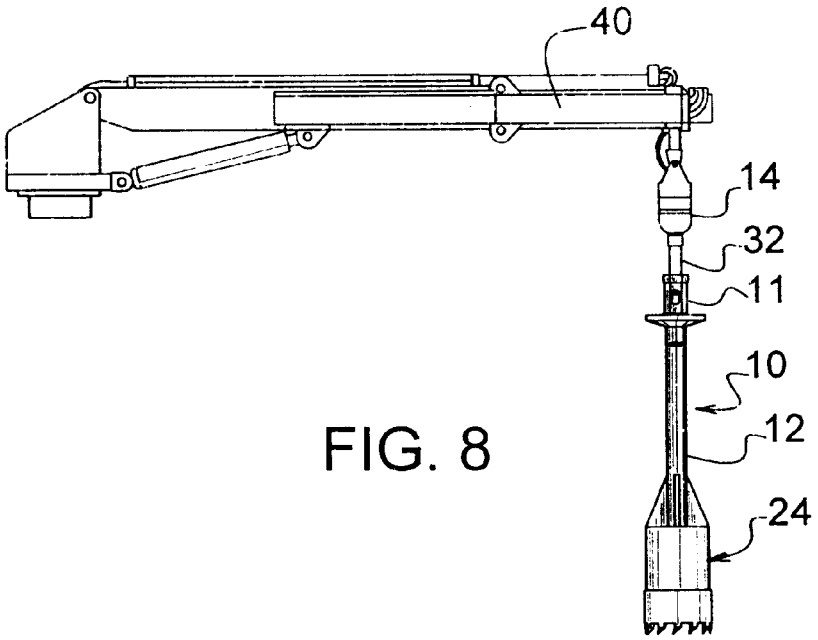
FIG. 8 is a perspective view of another embodiment of a life assembly suspending the present invention above the ground.

As shown in FIGS. 3 and 4, the distal end 13 of the shaft 12 is typically tubular having a circular cross-sectional dimension, wherein a quick disconnect cylindrical coupling 11 may be welded, pressed, screwed, or friction fitted to the distal end 13 of the shaft 12. The cylindrical coupling 11, preferably is shaped having a female socket end 30 for cooperative engagement with the male end of a drive shaft 32 of a motor 14 or pump drive unit 18. A pin may extend through the female socket end 30 and drive shaft 32 to provide the cooperative engagement; however, the preferred embodiment utilizes a coupling having a female socket end 30 sized and having a selected cross-sectional shape, to mate with a male drive shaft 32 having a square, hexagon, octagon or other shape for providing additional stability, rigidity, and stability to the connection therebetween. Moreover, the preferred embodiment includes a pin 33 which slides through a vertically elliptical keyway slot 34 to secure the quick connect coupling 11 to the drive shaft 32 of the drilling rig 16 permitting limited vertical movement therebetween as best shown in FIG. 3 so that the rock auger exerts floating pressure on the rock substrate by its own weight. A protective collar or flange 36 may extend circumferentially around the coupling 11. A key 38 may be inserted into a groove or orifice in the shaft 12 to provide an alignment indicator so that a user standing below the drilling boom 40 can look upward and align the keyway 34 of the rock auger with the key way of the pump motor drive shaft 32 for quick coupling of the units. The key 38 also provides an easy means to count the revolutions per minute of the auger 10.

The cutting head 24 is formed from a hollow cylindrical body 20 open at its lower open end 26. A plurality of conical shaped teeth 44 extend from generally rectangular shaped projections 46 extending from the outer peripheral edge 48 of the cutting head body 20. The conical shaped teeth 44 are equally spaced apart and angled slightly in a forward direction. The teeth 44 may also be angled inwardly or outwardly slightly to protrude pass the peripheral edge 48 of the hollow cylindrical body 20. For instance, the series of teeth 44 at the bottom edge of the hollow cylindrical body 20 may be alternately inwardly and outwardly displaced from the plane of the hollow cylindrical body 20. The displacement of the teeth 44 is such that the cut or kerf made in the rock or other hard substrate is slightly wider than the thickness of the hollow cylindrical body 20 to aid in extraction of the cutting head 24 from the hard substrate. The teeth 44 may also be provided with additional material so that each tooth is wider than the thickness of the side walls of the hollow cylindrical body 20.

One preferred hollow cylindrical body embodiment comprises an upper section 50 and lower section 52, wherein the lower section 52 defines a greater exterior diameter than the upper section 50 to facilitate removal of the cutting head 24 from the posthole and reduce or prevent binding during the drilling process.

The flightless auger 10 is designed for interchangeable use with a conventional flighted auger used for removal soil from the post holes. The quick disconnect feature of the flightless auger 10 makes the interchangeable augers practical to use together without wasting time. Upon hitting a hard substrate such as a rock ledge, the flighted auger can be disengaged in minutes and the flightless rock auger 10 attached to the drilling rig. The flightless auger 10 is lowered and raised with the hydraulic boom so that only the weight of the auger 10 exerts pressure on the rock substrate defining floating prressure. Although it is conceivable that pressure may be exerted on the auger 10 it is not necessary in that the weight of the auger 10 is sufficient to cut through hard material such as rock ledges. Usually it is sufficient to lower the flightless rock auger 10 into the hole and letting it rest on the hard substrate. Because the auger 10 is operated at a very low rpm, typically less than 10 revolutions per minute, ("rpm"), and preferably about 3 rpm, little dust is formed in the operation. Moreover, the wear and tear on the equipment is reduced if not eliminated as compared with the conventional drilling methods. This provides a very safe method of forming a plug of material within the cylindrical cutting head 24 for removal from the posthole. Upon breaking through the hard substrate and forming a plug therefrom, the flightless rock auger 10 is lifted from the hole and the plug removed by prying the plug out of the cylindrical body 20 with the use of pry bars which are extended into the openings 54 in the top of the cylindrical cutting head 24.

The foregoing detailed description is given primarily for clearness of understanding and no unnecessary limitations are to be understood therefrom, for modifications will become obvious to those skilled in the art based upon more recent disclosures and may be made without departing from the spirit of the invention and scope of the appended claims.

We claim:

1. A flightless rock auger for removing plugs of hard material from post holes, comprising:

a cylindrical hollow cutting head comprising a hollow cylindrical body defining side walls connecting a top end defining an upper periphral edge and a lower open end defining a lower periphral cutting edge including a plurality of teeth extending from said lower peripheral edge;

said top end of said hollow cylindrical body including at least one support member extending across at least a portion of said top end joining said side walls;

a shaft having a diameter less than said cutting head, said shaft including a proximal end connecting to said at least one support member and having an opposing distal end extending therefrom; and a quick disconnect coupling disposed upon said opposing distal end of said shaft, said disconnect including means for floating attachment to a drive shaft of a power unit providing limited vertical movement therebetween to exert floating pressure of said head and said shaft on said hard material by their own weights.

2. The flightless rock auger of claim 1, wherein said teeth are conical in shape.

3. The flightless rock auger of claim 1, including projecting members extending from said lower peripheral edge of said hollow cylindrical body said teeth extending from said projecting members.

4. The flightless rock auger of claim 1, including angling said teeth forwardly.

5. The flightless rock auger of claim 1, wherein said teeth are angled inwardly and outwardly extending slightly pass the lower peripheral edge of said hollow cylindrical body.

6. The flightless rock auger of claim 1, wherein said hollow cylindrical body includes an upper section and a lower section with said lower section defining a greater exterior diameter than said upper section facilitating removal of said cutting head from a hole and for reducing and preventing binding during the drilling process.

7. The flightless rock auger of claim 1, including at least one support reinforcement member connecting said top end of said cylindrical cutting head with said shaft providing additional lateral and rotational strength.

8. The flightless rock auger of claim 1, said shaft including a flange extending around the periphery thereof below said quick disconnect coupling.

9. The flightless rock auger of claim 1, said cylindrical hollow cutting head including at least one opening in the top end providing an opening for a tool for removing a plug from said cutting head upon removal of said flightless auger from the hole.

10. The flightless rock auger of claim 1, wherein said quick disconnect coupling defines a female socket end for cooperative engagement with a corresponding male end of a drive shaft of a motor or a hydraulic motor.

11. The flightless rock auger of claim 1, wherein said support member extending across said at least a portion of said top end joining said side walls is at least one strip of metal attaching to and extending across said upper periphral edge at two selected points.

12. The flightless rock auger of claim 1, wherein said means for floating attachment to said drive shaft comprises a vertical keyway slot extending through said quick disconnect coupling and cooperatively engaging a pin projecting through said quick disconnect coupling and said drive shaft.

13. The flightless rock auger of claim 12, said shaft including a key indicator in alignment with said keyway slot in said quick disconnect coupling.

14. A method of removing a plug of hard substrate from a posthole, using a flightless rock auger with a drilling rig, comprising the steps of:

a attaching said flight rock auger to a drive shaft of a power unit of the drilling rig, said flightless rock auger comprising a cylindrical hollow cutting head comprising a hollow cylindrical body defining side walls connecting a top end defining an upper peripheral edge and a lower open end defining a lower peripheral cutting edge including a plurality of teeth extending across at least a portion of said top end joining said side walls, a shaft having a diameter less than said cutting head, said shaft including a proximal end connecting to said at least one support member and having an opposing distal end extending therefrom, and a quick disconnect coupling disposed upon said opposing distal end of said shaft, said shaft disconnect coupling including means for floating attachment to said drive shaft of said power unit providing limited vertical movement therebetween to exert floating pressure of said cutting head and said shaft on said hard substrate by their own weights;

b) lowering said flightless rock auger into a posthole containing a hard substrate;

c) placing said flightless rock auger onto said hard substrate;

d) rotating said flightless rock auger at a low rpm for about 3 rpm to about 10 rpm;

e) forming said plug of hard substrate inside of said cylindrical body of said flightless rock auger;

f) lifting said flightless rock auger and said plug of hard substrate from said posthole; and g) removing said plug of hard substrate out of said cylindrical hollow cutting head.

* * * * *